US005257805A

United States Patent [19]

Belec et al.

[11] Patent Number: 5,257,805

[45] Date of Patent: Nov. 2, 1993

[54] PNEUMATIC VACUUM CUP FOR PAPER ACQUISITION

[75] Inventors: Eric A. Belec, Southbury; William J. Wright, Killingworth, both of Conn.

[73] Assignee: Pitney Bowes Inc., Stamford, Conn.

[21] Appl. No.: 17,169

[22] Filed: Feb. 12, 1993

[51] Int. Cl.[5] ..... B65H 5/00

[52] U.S. Cl. ..... 271/2; 271/90; 271/107

[58] Field of Search ..... 271/2, 20, 90, 97, 98, 271/103, 100, 102, 106, 107

[56] References Cited

U.S. PATENT DOCUMENTS

| | | | |
|---|---|---|---|
| 2,745,665 | 5/1956 | Labombarde | 271/103 |
| 4,351,518 | 9/1982 | Stievenart | 271/90 |
| 4,717,138 | 1/1988 | Watkiss | 271/103 |
| 4,728,093 | 3/1988 | Eberle | 271/103 |

FOREIGN PATENT DOCUMENTS

| | | | |
|---|---|---|---|
| 197801 | 7/1976 | Fed. Rep. of Germany | 271/106 |
| 3410963 | 10/1985 | Fed. Rep. of Germany | 271/107 |

*Primary Examiner*—Robert P. Olszewski
*Assistant Examiner*—Carol L. Druzbick
*Attorney, Agent, or Firm*—Charles R. Malandra, Jr.; Melvin J. Scolnick

[57] ABSTRACT

Apparatus for separating sheets of material. The apparatus includes: a device for supporting adjacent sheets of material; a vacuum cup for acquiring one of the adjacent sheets of material, the vacuum cup having a circumferential inner wall with an opening adjacent the one sheet of material and a circumferential outer wall coaxial with and surrounding but spaced from the inner wall, wherein the inner wall closes the end of the outer wall adjacent the one sheet of material, and wherein the outer wall includes a flexible, corrugated section enabling the outer wall to collapse in the axial direction; and a device to create separate vacuums within the inner wall and the outer wall, wherein the vacuum within the inner wall causes the vacuum cup to acquire the one material sheet and the vacuum within the outer wall causes the cup to collapse and move away from the supporting device to thereby separate the one material sheet from its adjacent sheets.

8 Claims, 3 Drawing Sheets

PNEUMATIC VACUUM CUP FOR PAPER ACQUISITION

BACKGROUND OF THE INVENTION

The instant invention relates to apparatus for separating sheets of material, e.g. paper, and more particularly to a pneumatically actuated vacuum cup for opening the throat of an envelope.

Many paper handling devices have used vacuum force for a wide variety of applications. Vacuum force has been used in the mail handling industry to aid in the opening of envelopes in order for paper documents to be inserted into the envelopes. In a typical envelope inserting system using vacuum, an envelope is lying face down and a vacuum apparatus is located thereabove and includes a vacuum cup mounted on a lever arm which extends back to a type of mechanically pivoting device (the vacuum supply tube may or may not be incorporated into the lever arm). At the appropriate time, the pivoting device rotates in a first direction to drive the vacuum cup lever downward toward the envelope. When the vacuum cup contacts the envelope, the cup is evacuated so that the cup "acquires" the panel of the envelope. At this time the pivoting device reverses direction to drive the vacuum cup lever upward and thereby open the envelope.

Although the foregoing vacuum acquisition apparatus has traditionally been a successful method of opening envelopes, the mechanical complexity of the pivoting mechanism and associated components (vacuum lever arm, etc.) are very costly and serve to limit both speed and reliability.

Accordingly, the instant invention provides a pneumatically actuated vacuum cup for paper acquisition which eliminates the need for the mechanical elements associated with prior art vacuum cups.

SUMMARY OF THE INVENTION

Thus, the instant invention provides apparatus for separating sheets of material. The apparatus includes: means for supporting adjacent sheets of material; a vacuum cup for acquiring one of the adjacent sheets of material, the vacuum cup having a circumferential inner wall with an opening adjacent the one sheet of material and a circumferential outer wall coaxial with and surrounding but spaced from the inner wall, wherein the inner wall closes the end of the outer wall adjacent the one sheet of material, and wherein the outer wall includes a flexible, corrugated section enabling the outer wall to collapse in the axial direction; and means to create separate vacuums within the inner wall and the outer wall, wherein the vacuum within the inner wall causes the vacuum cup to acquire the one material sheet and the vacuum within the outer wall causes the cup to collapse and move away from the supporting means to thereby separate the one material sheet from its adjacent sheets.

DETAILED DESCRIPTION OF THE PREFERRED EMBODIMENT

Figures 1, 2, 3, 4, 5:
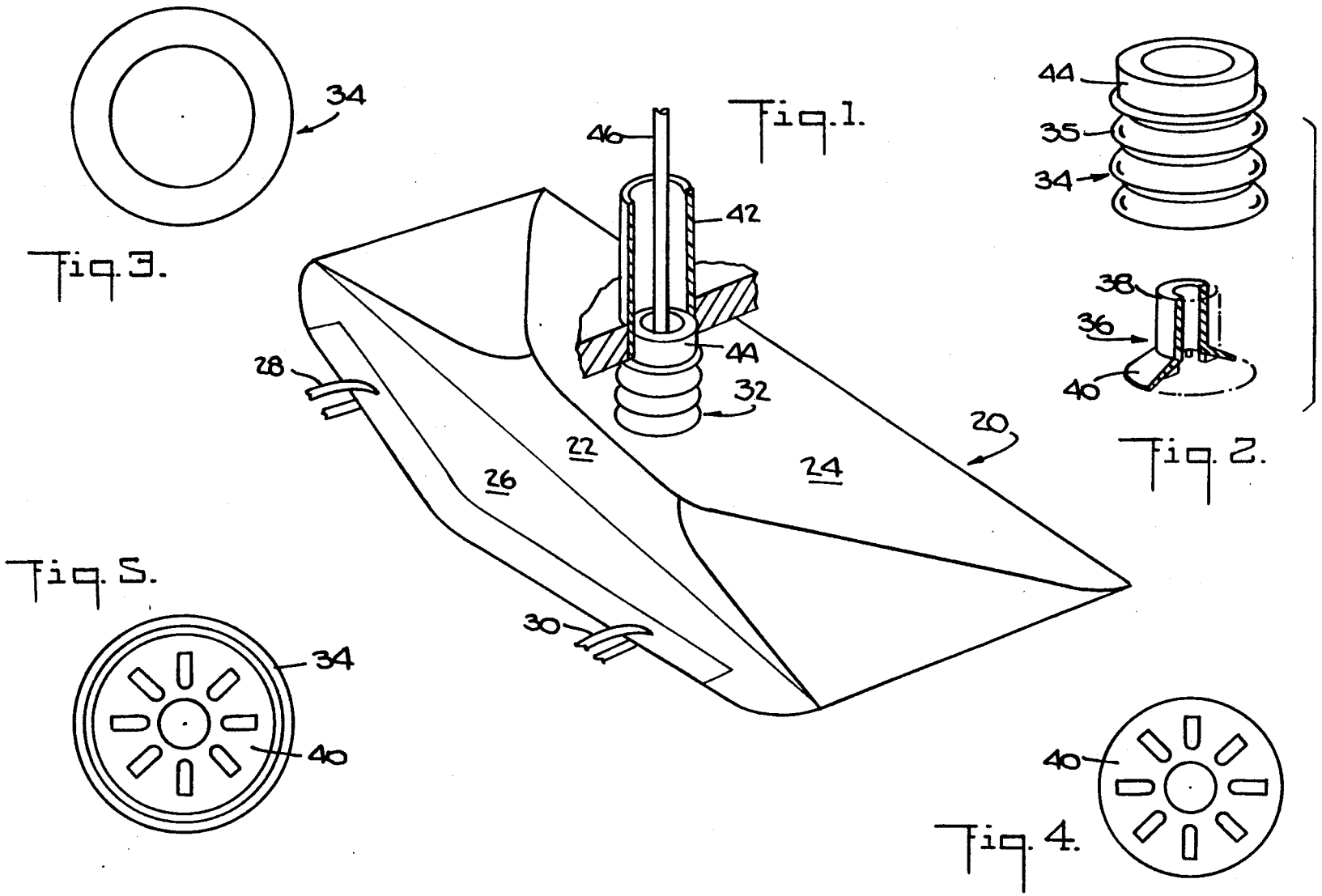
FIG. 1 is a perspective view of a back panel of an envelope being separated from the front panel of the envelope using a vacuum cup in accordance with the instant invention.
FIG. 2 is an exploded, perspective view of the outer wall and the inner wall of the vacuum cup seen in FIG. 1.
FIG. 3 is a bottom view of the vacuum cup outer wall seen in FIG. 2.
FIG. 4 is a bottom view of the inner wall of the vacuum cup seen in FIG. 2.
FIG. 5 is a bottom view of the outer and inner walls of the vacuum cup seen in FIG. 2.

In describing the preferred embodiment of the instant invention, reference is made to the drawings, wherein there is seen in FIG. 1 an envelope 20 having a front panel 22, a back panel 24 and a glue flap 26. The glue flap 26 is being held open for the insertion of documents by a pair of fingers 28 and 30. The back panel 24 is separated from the front panel 22 by a vacuum cup 32 discussed in detail hereinbelow.

Figure 6:
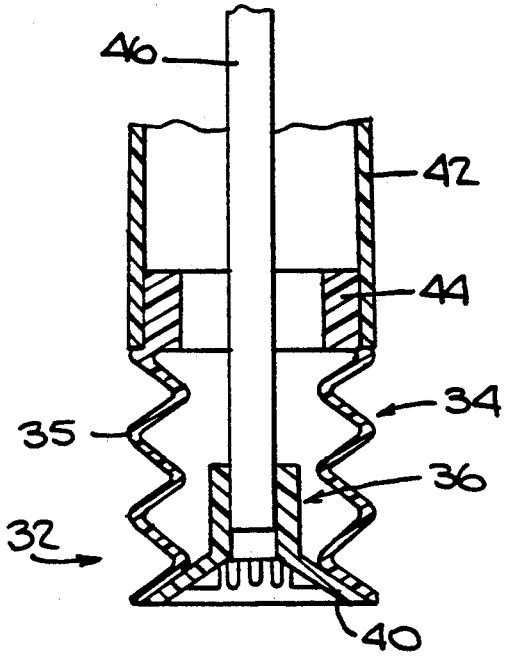
FIG. 6 is a vertical, sectional view of the vacuum cup seen in FIG. 2.

As best seen in FIGS. 2 and 6, the vacuum cup 32 includes a circumferential outer wall 34 which is open at its top and bottom ends. The outer wall 34 is formed of a flexible material, such as rubber or plastic, and has a corrugated section 35 so that it is capable of translation in the vertical direction if one end is fixedly secured. The cup 32 also includes an inner wall 36 having a tubular, upper section 38 which fits within the outer wall 34 and a flanged, lower section 40. The inner wall 36 is also open at its top and bottom ends, but the flange 40 fits against the bottom of the outer wall 34 and thereby seals the bottom of the outer wall 34, so that effectively a bladder is formed. It should be noted that the outer wall 34 and the inner wall 36 can be formed as one part and thus be integral.

Figure 7:
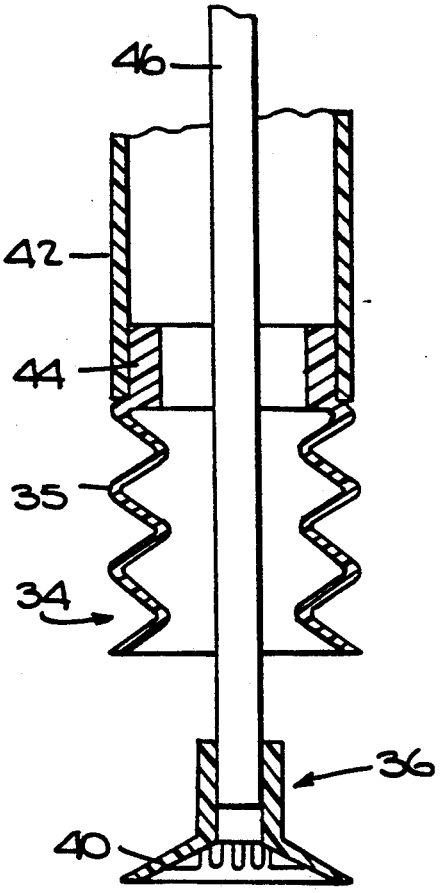
FIG. 7 is similar to FIG. 6 but the outer and inner walls of the vacuum cup are exploded.

Referring now to FIGS. 6 and 7, an outer tube 42 is seated within the top, cylindrical portion 44 of the outer wall 34 and is connected to a vacuum pump (not shown). An inner tube 46 is seated within the outer wall tubular section 38 and is also connected to a vacuum pump (not shown). Although the two tubes 42 and 46 which are employed to create vacuums within the walls 34 and 36 respectively are shown as co-axial, it is not necessary that they be so, as shown by the alternative embodiment tubes 42' and 46' in FIG. 8.

Figure 9:
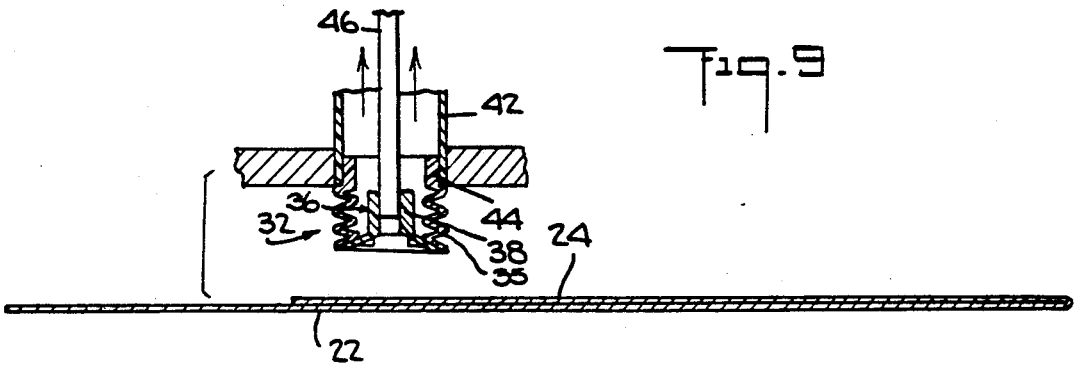
FIG. 9 is a vertical, sectional view showing the vacuum cup prior to engagement with the envelope back panel.

The operation of the vacuum cup 32 to separate the back panel 24 from the front panel 22 of envelope 20 is as follows: The envelope 20 is moved into position as seen in FIG. 9 so that the open end of the back panel 24 is situated appropriately beneath the vacuum cup 32. During the period of envelope movement, the vacuum cup 32 is raised above the back panel 24 by means of a vacuum force applied through outer tube 42 within the outer wall 34. The vacuum causes the corrugated, flexible section 35 of the outer wall 34 to collapse in an upward direction against the top, cylindrical portion 44, as seen in FIG. 9. It is the seal created between the outer wall 34 and the flange 40 of the cup 32 that creates a "bladder" between the inner and outer walls 36 and 34 respectively. When vacuum force is applied through outer tube 42 to evacuate the "bladder", the corrugated portion 35 of the outer wall 34 collapses in the upward direction. Correspondingly, the cup inner wall 36 and inner tube 46 are displaced upward a similar dimension.

Figure 10:
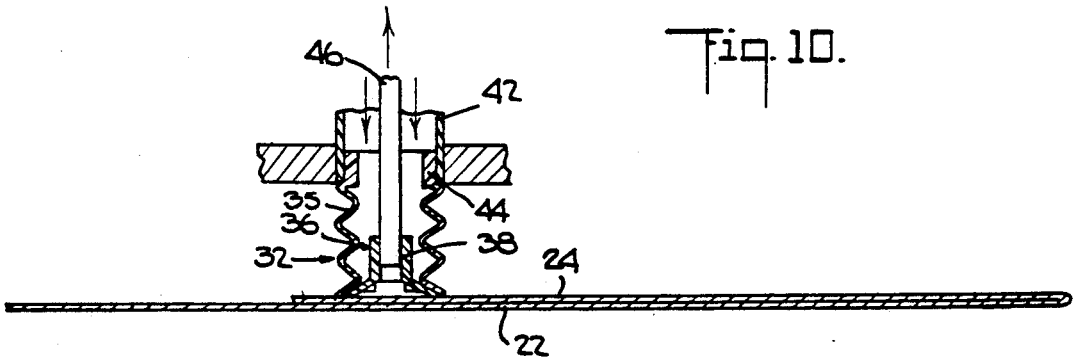
FIG. 10 is similar to FIG. 9 but shows the vacuum cup in engagement with the envelope back panel.

In order for the two envelope panels 22 and 24 (or separate, individual sheets) to be separated, the cup 32 at the bottom surface of its walls 34 and 36 must come into contact with the envelope 20. To accomplish this, the bladder between the outer wall 36 and inner wall 34 is filled with air by means of the outer tube 42. This causes the bladder to "balloon" outward as shown in FIG. 10. The corrugated section 35 of the outer wall 34 expands downward so that the cup 32 comes into contact with the envelope back panel 24. Correspondingly, the cup inner wall 36 and the inner tube 46 are displaced downward until the cup 32 contacts the envelope back panel 24.

Figure 11:
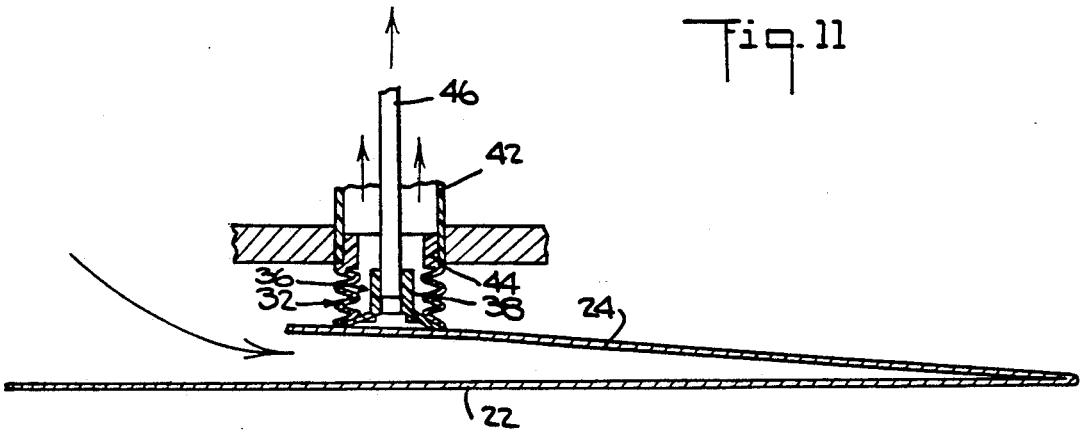
FIG. 11 is similar to FIG. 10 but shows the vacuum cup separating the back panel from the front panel of the envelope.

Once contact between cup 32 and envelope back panel 24 is made, the inner wall 36 is evacuated by means of the tube 46 so that the cup 32 acquires the back panel 24 of the envelope 20. After panel acquisition has been made, the bladder between walls 34 and 36 is evacuated (through the outer tube 42) which causes the cup 32 to be raised due to the upward collapse of the assembly (described above). The continued evacuation of the inner wall 36 by the inner tube 46 during the rise of the cup 32 (as the assembly collapses upward) separates the back panel 24 from the front panel 22 of the envelope 20 (see FIG. 11). The envelope 20 is now prepared for insertion.

Figure 8:
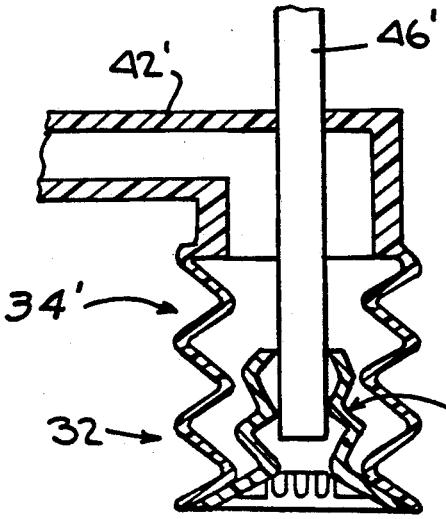
FIG. 8 is a vertical, sectional view of an alternative embodiment of the vacuum cup seen in FIG. 6.

Although the inner wall 36 is shown as a straight cylinder, it can be corrugated similar to the outer wall 34 as shown in FIG. 8, which has the advantage of eliminating vertical displacement of the inner tube 46.

From the foregoing description, it can be seen that the envelope 20 is opened with a vacuum cup which does not utilize any mechanical elements. The vertical translation of the cup 32 is achieved by the design of the outer wall 32 which is both flexible and corrugated to allow for vertical movement in response to the presence of a vacuum.

It should be understood by those skilled in the art that various modifications may be made in the present invention without departing from the spirit and scope thereof, as described in the specification and defined in the appended claims.

What is claimed is:

1. Apparatus for separating sheets of material, comprising:

means for supporting adjacent sheets of material;

a vacuum cup for acquiring one of said adjacent sheets of material, said vacuum cup having a circumferential inner wall with an opening adjacent said one sheet of material and a circumferential outer wall coaxial with and surrounding but spaced from said inner wall, wherein said inner wall closes the end of the outer wall adjacent said one sheet of material, and wherein said outer wall includes a flexible, corrugated section enabling said outer wall to collapse in the axial direction; and means to create separate vacuums within said inner wall and said outer wall, wherein the vacuum within said inner wall causes said vacuum cup to acquire said one material sheet and the vacuum within said outer wall causes said cup to collapse and move away from said supporting means to thereby separate said one material sheet from its adjacent sheets.

2. The apparatus of claim 1, wherein said inner wall includes a corrugated section.

3. The apparatus of claim 1, wherein said inner wall includes a tubular upper section and a flanged, lower section for closing the outer wall.

4. The apparatus of claim 3, wherein said vacuum creating means comprises separate tubes for the inner and outer walls.

5. The apparatus of claim 1, wherein said inner wall and said outer wall are integral.

6. The apparatus of claim 4, wherein said cup is formed from a rubber or plastic.

7. The apparatus of claim 6, wherein said material comprises paper.

8. The apparatus of claim 7, wherein said sheets of paper comprise the front and back panels of an envelope.

* * * * *